US006227833B1

(12) United States Patent
Frøslev et al.

(10) Patent No.: US 6,227,833 B1
(45) Date of Patent: May 8, 2001

(54) FLUID MACHINE HAVING COOPERATING DISPLACEMENT ELEMENTS AND A HOUSING PARTIALLY COVERING THE DISPLACEMENT ELEMENTS

(75) Inventors: Peter Frøslev, Sydals; Ingvard Mosby Madsen, Sønderborg; Jørn Holger Klausen; Franz Thomsen, both of Nordborg, all of (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 09/402,906

(22) PCT Filed: Apr. 22, 1998

(86) PCT No.: PCT/DK98/00163

§ 371 Date: Oct. 12, 1999

§ 102(e) Date: Oct. 12, 1999

(87) PCT Pub. No.: WO98/48148

PCT Pub. Date: Oct. 29, 1998

(30) Foreign Application Priority Data

Apr. 24, 1997 (DE) ..... 197 17 295

(51) Int. Cl.[7] ..... F01C 1/10; F01C 1/18

(52) U.S. Cl. ..... 418/170; 418/171; 418/179; 418/206.1; 29/888.023

(58) Field of Search ..... 418/166, 168–171, 418/179, 206.1, 206.4, 270; 29/888.023

(56) References Cited

U.S. PATENT DOCUMENTS

| | | | | |
|---|---|---|---|---|
| 2,639,694 | * | 5/1953 | Johnson | 418/206.1 |
| 2,936,717 | * | 5/1960 | Kalle | 418/206.1 |
| 3,136,261 | * | 6/1964 | Eckerle et al. | 418/169 |
| 3,478,694 | * | 11/1969 | Morando | 418/206.1 |
| 5,388,974 | * | 2/1995 | Streiff | 418/206.4 |
| 5,797,734 | * | 8/1998 | Kizer et al. | 418/179 |

FOREIGN PATENT DOCUMENTS

| | | | | |
|---|---|---|---|---|
| 2223916 | * | 11/1973 | (DE) | 418/169 |

* cited by examiner

*Primary Examiner*—John J. Vrablik
(74) *Attorney, Agent, or Firm*—Lee, Mann, Smith, McWilliams, Sweeney & Ohlson

(57) ABSTRACT

There is disclosed a hydraulic or pneumatic machine having a first displacement element (8) that is rotatable about an axis of rotation connected to a shaft (10) so as to rotate therewith, which shaft is mounted rotatably in a housing (2), and co-operates with a second displacement element (9). The structure of such a machine is to be improved. For that purpose, the housing (2) has a pocket (3) in which the displacement elements (8, 9) are so arranged that the housing (2) covers the displacement elements (8, 9) axially on both sides (4, 5) at least in a working region and in the circumferential direction over a maximum of 180°.

18 Claims, 3 Drawing Sheets

FLUID MACHINE HAVING COOPERATING DISPLACEMENT ELEMENTS AND A HOUSING PARTIALLY COVERING THE DISPLACEMENT ELEMENTS

The invention relates to a fluid machine having a first displacement element that is rotatable about an axis of rotation, connected to a shaft so as to rotate therewith, which shaft is mounted rotatably in a housing, and co-operates with a second displacement element, the axis of rotation being arranged at a predetermined distance from the centre axis of the second displacement element.

Such machines are used both as pumps, in which the shaft is driven by a motor, for example an electric motor, and as motors, in which fluid is supplied under pressure to the displacement elements so that at least the displacement element that is connected to the shaft rotates and can deliver a mechanical output. As fluid there may be used a liquid or a gas. In the former case, the machines are hydraulic machines and, in the latter case, they are pneumatic machines. The following explanation is based on the example of hydraulic machines.

Such hydraulic machines have been known for a long time. In order for them to operate well, that is to say with acceptable efficiency, the parts must be matched with one another with small tolerances. If the gaps between moving parts are too great, the volumetric efficiency deteriorates as a result of internal leakages. If, on the other hand, the fits are too tight, increased losses due to friction occur, which likewise reduce efficiency. Adherence to close tolerances renders production difficult, which results in a corresponding increase in the costs of such machines.

The problem underlying the invention is to simplify the construction of such machines.

The problem is solved in a hydraulic machine of the type mentioned at the outset in that the housing has a pocket in which the displacement elements are so arranged that the housing covers the displacement elements axially on both sides at least in a working region and in the circumferential direction over a maximum of 180°.

That construction starts from the conventional design in which it is assumed that the displacement elements have to be arranged in a chamber that is sealed on all sides. Instead, one side is left open. The displacement elements can be inserted through that opening of the pocket in which the chamber is formed. Since the pocket is arranged in the housing, it can be manufactured with predetermined precision which is no longer altered, or is altered only to a small degree, by subsequent assembly steps. The displacement elements can also be manufactured with predetermined precision in such a manner that they fit axially exactly into the pocket. Further assembly steps to close off the pocket, which might again be troubled by tolerances, are not necessary. This becomes possible as a result of the recognition that a pressure needs to be enclosed only in the so-called working region. Accordingly, it is sufficient for the housing to cover the working region. The working region is the region between the displacement elements in which, in a pump, the hydraulic fluid is placed under pressure, generally by reducing the volume of chambers formed between the displacement elements or, in the case of a motor, the region into which the hydraulic fluid is fed to effect an expansion of work chambers. If it is no longer necessary for work chambers to be closed off in such a manner, then a pressure-tight covering by the housing, and the complication that that involves, is also unnecessary. The opening that is necessary for assembly can therefore be left open without it being necessary to accept a deterioration in the running properties of the machine. As a result, production is simplified dramatically and the production costs may also be reduced.

Preferably, an axial end wall of the pocket has a slit. The slit is provided mainly for manufacturing reasons. In most cases, the pocket must be of arcuate cross-section in the region in which it surrounds the displacement elements in the circumferential direction. Such a cross-section is obtained advantageously by using a milling cutter, the axis of rotation of which runs parallel to the future axis of rotation of the first displacement element. If it is desired to introduce the displacement elements further into the pocket, that is to say, for example, so that they are completely inside the housing, then the milling cutter must be introduced correspondingly deeply. The slit serves that purpose, enabling, for the manufacture of the pocket, an appropriately deep insertion of the milling cutter and its drive shaft into the housing. The slit can be made at the same time as the pocket. Alternatively, it can be produced in an earlier work operation.

Advantageously, the slit is arranged offset to the side of the shaft. That ensures that the working region between the displacement elements is covered by the end face even when the end face comprises the said slit.

Advantageously, the shaft projects through the first displacement element and into an opening at the end of the slit. The shaft is thus guided not only in the housing on one side of the displacement element but, by the projecting end, also in the opposite end wall of the pocket. Although that guidance is weaker because the slit effects an interruption in the guidance, it is still sufficient to provide high stability of the shaft mounting.

During assembly, advantageously, the shaft is movable only axially relative to the housing and the displacement elements are movable only radially relative to the housing. The displacement elements are inserted radially into the pocket. The shaft can be inserted into the housing at the same time or thereafter. When the shaft is moved in the axial direction, it passes through the displacement elements and thereby holds the displacement elements captive in the pocket. The displacement elements can thus no longer be moved outwards through the opening of the pocket. A self-securing mechanism is thus produced for at least one direction of movement.

This is further improved by fastening the shaft axially to the first displacement element. As soon as the fastening has been effected, the machine is fully assembled at least in respect of its main function. The shaft cannot be removed axially from the housing because the fastening to the displacement element prevents such a movement, nor can the displacement elements be removed sideways from the pocket because the shaft stops such a movement. Since only two work steps are required to achieve that "final assembled state", which steps are, moreover, relatively simple to effect and can be carried out, for example, by a production robot, manufacture involves very little complication, with accordingly low costs.

Preferably, the axial extent of the pocket is substantially as great as that of the displacement elements. The two end faces of the pocket thus seal the displacement elements, that is to say together with the displacement elements they define work chambers that can increase and decrease in size during operation. Additional elements, such as seals, are not required. The corresponding work chambers are created by the insertion of the displacement elements into the pocket.

The displacement elements and the housing preferably have similar thermal expansion coefficients. As a result, operation with equal efficiency is possible even with varying temperatures.

Advantageously, there is provided in the housing a high-pressure channel arrangement which is connected to the working region. When the machine is used as a pump, the high-pressure channel arrangement takes up the hydraulic pressures that are produced and passes them on to a high-pressure connection from which hydraulic fluid can then be taken off at the desired higher pressure. When the machine is used as a motor, hydraulic fluid is supplied under relatively high pressure to the work chambers by way of the high-pressure channel arrangement in order to cause the work chambers to expand. Only the high-pressure channel arrangement needs to be produced so as to have the necessary strength, for which purpose the housing is advantageously provided. That specification is not necessary in a low-pressure channel arrangement. Accordingly, such a low-pressure channel arrangement is not strictly necessary. For example, the machine can be used as a pump by immersing it completely in a fluid to be pumped, for example in the fuel tank of a motor vehicle. The fluid can then flow in by way of the open side of the pocket and the slit and is passed onwards by way of the high-pressure channel arrangement.

Preferably, a predetermined number of work chambers are formed in the working region between the two displacement elements and the housing has a corresponding number of high-pressure channel openings which are connected to one another and are so arranged that each work chamber is always connected to at least one high-pressure opening. In the working region, the volumes of the work chambers decrease when the machine is used as a pump. Since each work chamber is always connected to at least one high-pressure channel opening, it can displace the hydraulic fluid through that opening. That is necessary because fluids generally cannot be compressed. Different pressures are, of course, produced in different work chambers, which depends, inter alia, on how far the decrease in volume has progressed. Those pressures are, however, equalized as a result of the connection of the work chambers by way of the high-pressure channel openings, with the result that the total increase in pressure in the working region can be taken from the high-pressure channel opening. A so-called kidney, which is present in other machines, is not necessary in this case. The individual openings are to be manufactured with little complication. Nor do they result in any noticeable weakening of the end face in which the openings have been made, which in turn results in less complication and consequently a reduction in the costs.

Advantageously, the slit forms a part of a low-pressure channel arrangement. As explained above, it is not absolutely necessary for the displacement elements to be encapsulated in the low-pressure region. Instead, in that region the hydraulic fluid can flow in or out unhindered (depending on whether the machine is being used as a pump or as a motor). The slit, which is generally of a certain length, provides only low resistance to the hydraulic flow, which low resistance can preferably be exploited to increase the efficiency of the machine.

It is especially preferred for the housing to be connected to a motor, especially an electric motor, and for the machine and the motor to have a common bearing and/or a common shaft. In particular, when the machine is used as a pump a very compact pump unit is thus obtained which can, moreover, be produced very inexpensively.

That is especially the case when the common bearing is mounted in the housing. The housing still needs to have a certain degree of stability. That stability can then also be exploited to support the bearing.

Advantageously, a cover is provided which covers at least the opening of the pocket in the housing. As explained above, such a cover is not necessary when the machine, in the form of a pump, is immersed directly in the fluid to be pumped. That particular application will, however, be relatively rare. If it is desired to pump the fluid around a circuit or if it is desired to use the fluid as a drive medium for a motor in such a circuit, care must be taken to ensure that the fluid at the machine cannot escape from the circuit. The cover is provided for that purpose. The requirements placed on the cover in terms of compressive stresses are, however, only relatively low because it is in the low-pressure region. It merely needs to be able to prevent the hydraulic fluid from escaping at low pressures. The sealing arrangements required for that purpose can also be manufactured with accordingly little complication.

Preferably, the housing is cylindrical and the cover has a matching cylindrical cavity in which the housing is arranged.

During manufacture it is then no longer absolutely necessary for the housing to be inserted into the cover with the correct orientation. The pocket is covered in every case. Furthermore, such an arrangement can be sealed more easily.

Preferably, the cover has fluid channels. It is much simpler to have the fluid channels in the cover rather than in the housing. That also reduces production costs.

Preferably, the cover is formed by a machine element that has at least one additional function. An additional part is therefore no longer needed to cover the pocket. The covering function can be provided by a machine part that is already present. This makes it possible to integrate a machine, that is to say a pump or a motor, directly in an appropriate machine part without requiring additional construction space and additional fastening elements.

Advantageously, the machine part is a component of a hydraulic sub-assembly. That use will be selected particularly when the hydraulic machine is in the form of a pump. The hydraulic sub-assembly may, for example, be a hydraulic piston/cylinder arrangement. The pump would then be arranged, for example, in the cylinder. The hydraulic cylinder can then be moved by driving the motor, without an external hydraulic supply being required. The pressure is instead produced directly in the immediate vicinity of the pressure chamber. In that manner, a number of actuation tasks can be solved hydraulically, for which such use was hitherto not possible because of the lack of hydraulic supply. Advantageous fields of use include any in which a single hydraulic cylinder is sufficient, for example in a drive for a gate.

Advantageously, the cover separates the low-pressure channel arrangement from the environment and has a low-pressure connection. The machine can then be operated just like conventional machines, that is to say it is connected to a high-pressure connection and to a low-pressure connection and is then ready for use. As stated above, owing to the cover there is no risk of hydraulic fluid escaping.

In an advantageous construction, the cover may also comprise means for controlling pressure and/or for controlling temperature and/or for regulating a fluid flow. Those means may be added on to the cover as attachments or they may be integrated in the cover.

Preferably, the cover forms an axial bearing for the shaft. In that construction it is necessary to secure the shaft in the displacement element in one direction only. Movement of the shaft in the other direction is limited or prevented by the cover. That is especially advantageous because the axial securing of the shaft in the displacement element can be effected on that side on which the shaft projects through the displacement element, that is to say on the side on which the slit is also provided in the end wall. The other side of the displacement element, where the displacement element rests against the other end face of the pocket and thus against the housing, no longer needs to be accessible.

Advantageously, the shaft is sealed in the housing by a shaft seal which is connected to the displacement elements by way of a channel that extends substantially parallel to the axis. By virtue of the channel, the site of the shaft seal can be selected freely. It is thus no longer necessary for the shaft seal to be arranged in the immediate vicinity of the working region. As a result, no further processing steps to provide a mounting site for the shaft seal are required in the vicinity of the displacement elements.

Advantageously, the displacement elements co-operate in the manner of a gerotor. In that case, the displacement elements are an inner toothed wheel having teeth on the outside and an outer toothed ring having teeth on the inside. The centre points of the two displacement elements are offset eccentrically in relation to one another. The toothed wheel that forms the first displacement element is connected to the shaft so as to rotate therewith. When the toothed wheel rotates, the toothed ring rotates also. It is supported in the pocket to rotate through a maximum of 180° and can thus rotate freely in the pocket. The working region in a gerotor is approximately 180°. In that region, the two end faces of the pocket can cover the work chambers axially.

Preferably, the first displacement element is in the form of a toothed wheel having teeth on the outside and the second displacement element is in the form of a toothed ring having teeth on the inside and having a different number of teeth. Generally, the toothed ring has more teeth than the toothed wheel. It is thus possible to obtain a particular transmission ratio, that is to say the toothed ring rotates more slowly than the toothed wheel.

Advantageously, there is arranged between the toothed wheel and the toothed ring, within a predetermined angular region, a sickle-shaped insertion piece that is fixed relative to the housing. The teeth of the toothed wheel slide radially inwardly along that insertion piece and the teeth of the toothed ring slide along it radially outwardly. Between the teeth in question there are thus formed work chambers that have a constant volume in the region of the insertion piece.

In that manner, with little complication it is possible to convey the hydraulic fluid to the regions in which the work chambers respectively decrease and increase in size and where the covering by the end faces of the pocket is required.

In a different construction, both displacement elements may be in the form of toothed wheels. That then constitutes a conventional toothed wheel pump, as is generally known. In that case, the cross-section of the pocket is bounded at one end by two arcuate sections lying adjacent to one another, the corresponding circles overlapping one another sufficiently for the two toothed wheels to be able to engage one another. Such a pocket can be produced, for example, by two milling operations in which the milling cutter has the same outer diameter as the toothed wheels. Two slits may also be provided without difficulty in the corresponding end face of the pocket. The working region is limited to a relatively small angular region.

Preferably, the housing is made of plastics, sintered material, aluminium, ceramics or cast iron. Such materials can be shaped easily. They are sufficiently resistant to withstand the stresses.

It is especially preferred for the housing material to comprise additives to increase the mechanical strength and/or the resistance to wear and/or to reduce friction. By means of such additives the operating behaviour of the pump can be improved further.

The invention is described hereinafter with reference to preferred embodiments, in conjunction with the drawings, in which.

Figure 2:
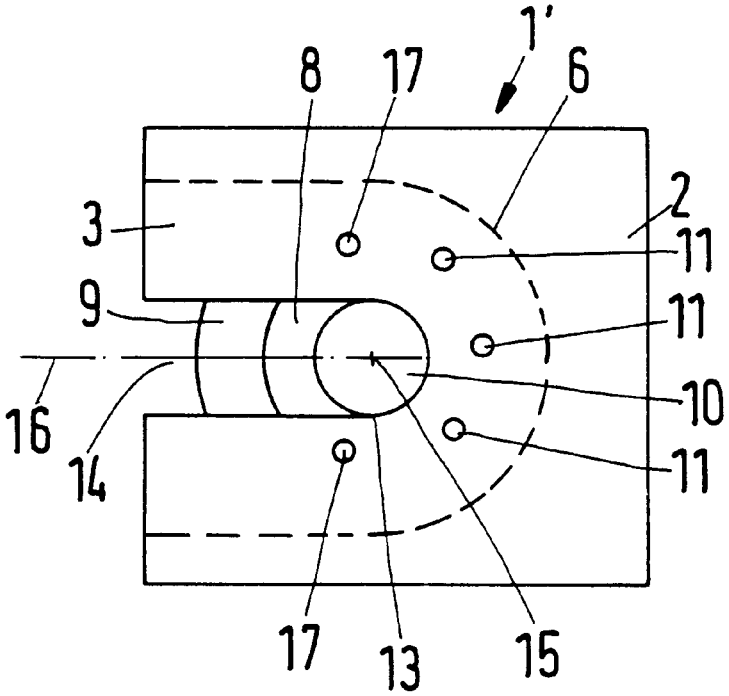
FIG. 2 is a plan view of a similar embodiment of the machine.

A hydraulic machine 1, which can be in the form of a motor or a pump, has a housing 2. In the housing 2 there is arranged a pocket 3 which is bounded axially by two end walls 4, 5. The pocket 3 is closed at its base 6. On the side that is opposite to the base there is an opening 7. As can be seen from FIG. 2, the base 6 is arcuate in cross-section. In FIG. 2, the pocket 3 is shown by a broken line.

Arranged in the pocket 3 is a displacement element arrangement that consists of a first displacement element 8, which is, for example, in the form of a toothed wheel, and a second displacement element 9, which is in the form of a toothed ring. A rotary piston arrangement or a vane arrangement would also be possible. The first displacement element 8 is connected to a shaft so as to rotate therewith, which shaft is mounted rotatably in the housing 2.

The two displacement elements 8, 9 have the same axial extent as the pocket 3. Between the two displacement elements 8, 9 there are provided work chambers that alternately increase and decrease in size in a known manner during operation. Those work chambers are sealed by the two end walls 4, 5.

Since the fluid is not compressible, there are in the housing 2 in a working region high-pressure channel openings 11 which are connected to a high-pressure connection 12. The working region is, in a pump, the region in which the work chambers decrease in size and, in a motor, the region in which the work chambers increase in size.

The housing 2 and the displacement elements 8, 9 have similar thermal expansion coefficients. The good sealing between the end walls 4, 5 and the displacement elements 8, 9 is therefore maintained during operation largely independently of changes in temperature.

The shaft 10 is connected to the first displacement element 8 not only so as to rotate therewith; it is also connected axially to the first displacement element 8, that is to say it is held therein captively. That renders assembly of the machine relatively simple. The displacement elements 8, 9 are first inserted inside one another axially and then introduced as a sub-assembly into the pocket 3. When the shaft 10 is inserted through the housing and into the inner displacement element 8, the machine is, in effect, finished.

It is not prejudicial for the pocket 3 to be open at the opening 7. Hydraulic fluid can flow in or out through the opening 7 without that being prejudicial to the operation of the machine. In the simplest form, the machine may be arranged, for example, in the form of a pump, directly in a supply of the fluid to be pumped. Fluid can then be sucked up by way of the opening 7 of the pocket 3 or by way of other channels and can be delivered by way of the high-pressure connection 12. Of course, in that case the high-pressure connection 12 is provided with a corresponding discharge line.

FIG. 2 shows a slightly modified embodiment of a machine 1; as explained above, the pocket 3 is here represented by a broken line.

Figure 1:
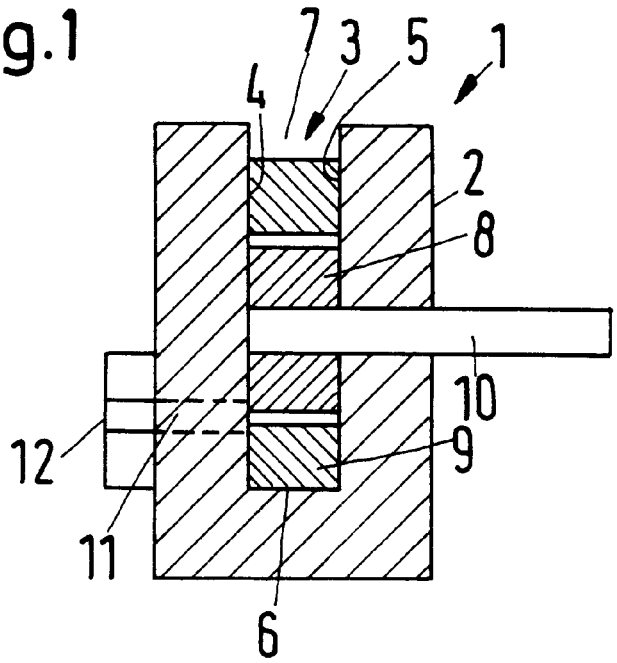
FIG. 1 is a diagrammatic cross-section of a first embodiment of a machine according to the invention.

Compared with the embodiment in FIG. 1, a slit 14 has been added in the end wall 4, in which end wall there are also arranged the high-pressure channel openings 11. That slit serves to facilitate manufacture. The pocket 3 can be manufactured using a milling cutter, the diameter of which corresponds to the outer diameter of the second displacement element 9. The slit 14 is provided to enable the milling cutter to be introduced sufficiently deeply into the housing 2. The arbor of the milling cutter can be moved in the slit 14.

A bore 13 is also provided at the foot of the slit 14, which bore serves to receive the shaft 10 or, more precisely, an end that projects through the first displacement element 8. It can be seen that the axis 15 of the shaft 10 is slightly offset relative to the centre line 16 of the slit 14. This enables the two displacement elements 8, 9 to be arranged eccentrically relative to one another, for example in order to provide a gerotor arrangement.

In the construction according to FIG. 2, the working region is located to the right of a vertical line running through the axis 15 of the shaft 10. Channel openings 17 are also provided outside the working region, through which the hydraulic fluid can flow at a lower pressure. Hydraulic fluid can also pass through the slit 14 into the work chambers between the two displacement elements 8, 9. The number of high-pressure channel openings 11 and channel openings 17 ensures that each work chamber has a connection to a supply or discharge. Each work chamber is thus always connected to at least one of those openings 11, 17, 14 so that fluid can always be displaced or can always flow in.

In a manner not shown, the high-pressure channel openings 11, on the one hand, and the channel openings 17 and the slit 14, on the other hand, are connected to one another so that in each case pressure equalisation can take place between those openings. A kidney, as is usually customary in hydraulic machines of that type, can be omitted in this case.

Figure 3:
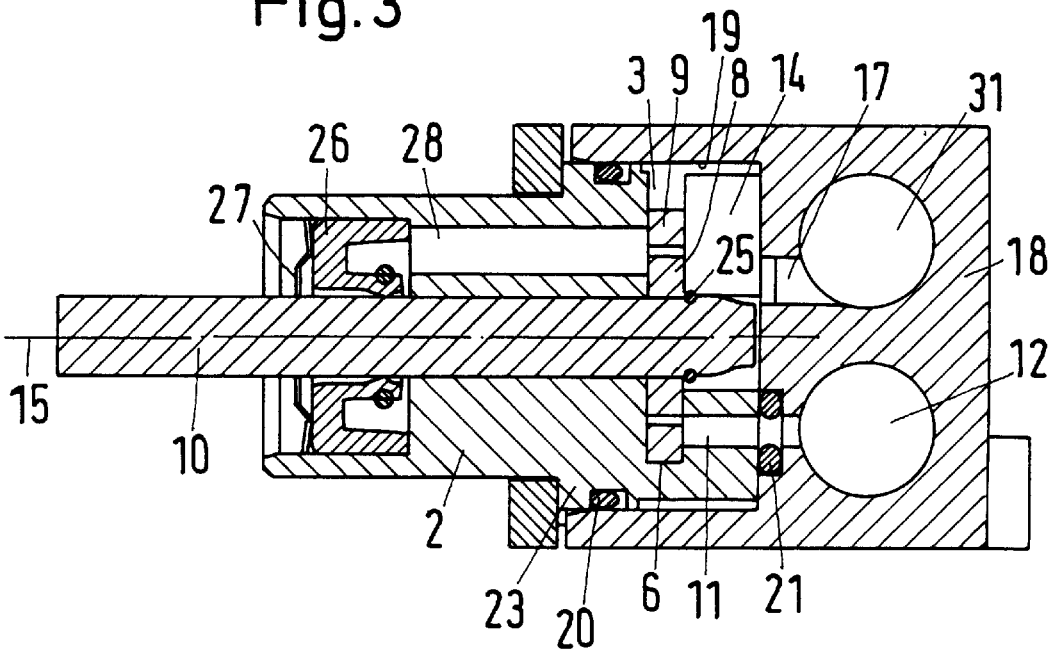
FIG. 3 is a section through a third embodiment of the machine.
Figure 4:
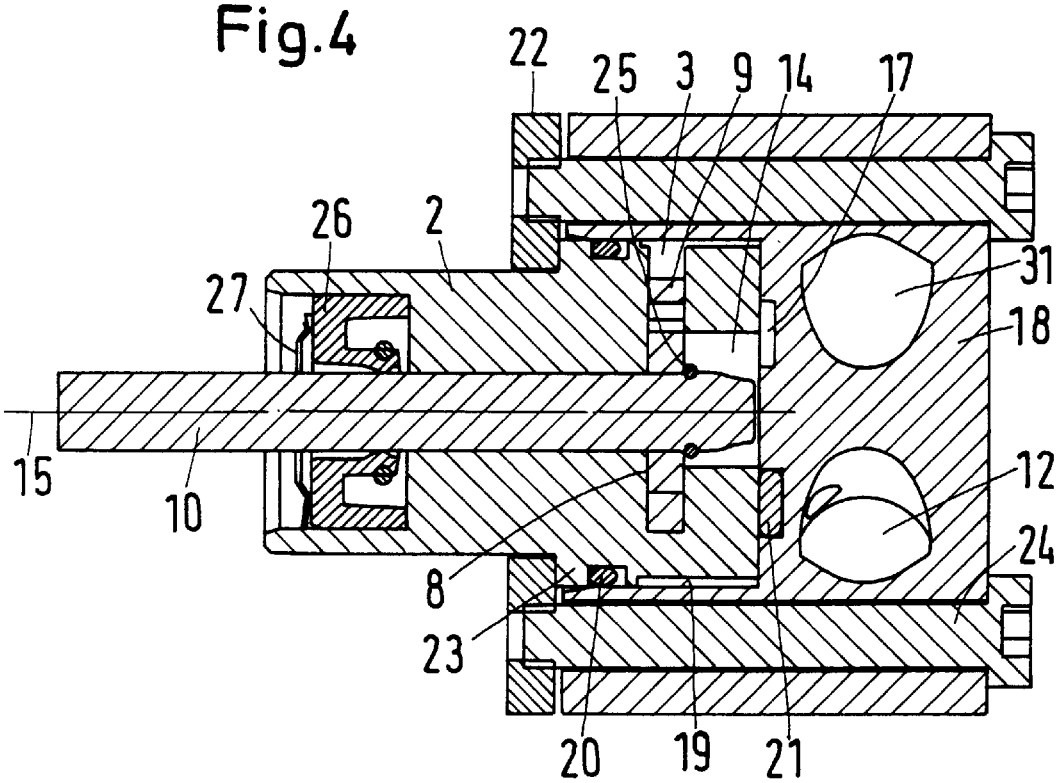
FIG. 4 is another section through the embodiment according to FIG. 3.
Figure 5:
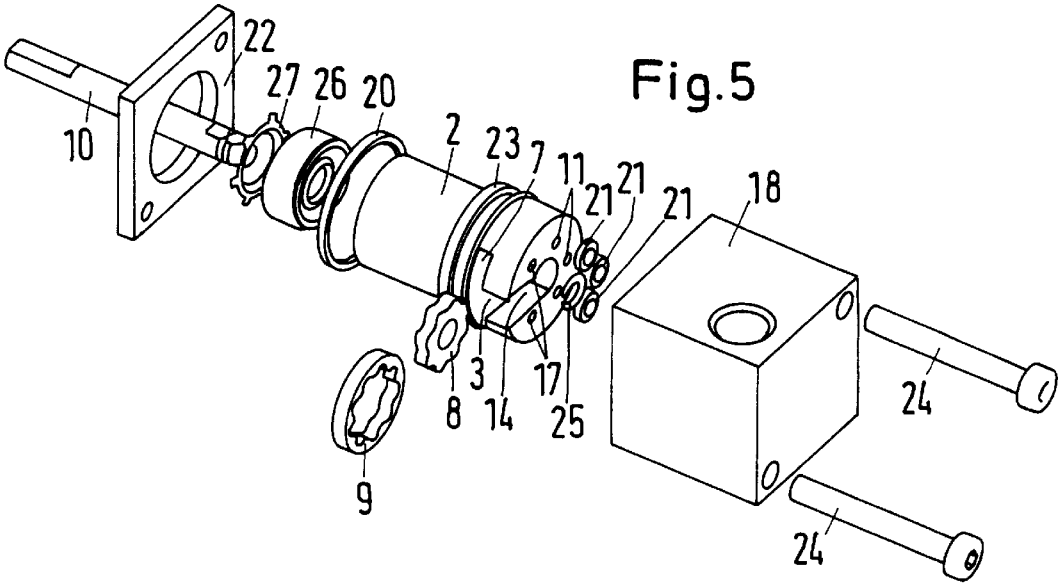
FIG. 5 is an exploded view of the machine according to FIGS. 3 and 4.

FIGS. 3 to 5 show a further embodiment of the invention, with FIGS. 3 and 4 showing different longitudinal sections, whilst FIG. 5 is an exploded view. Identical parts have been given identical reference numerals.

Since, in most cases, the machine is not inserted into a supply of fluid, but is to be used in a normal environment in which, if possible, no fluid should escape, the machine in FIGS. 3 to 5 is provided with a cover 18. As can be seen from FIG. 5, the housing 2 is approximately cylindrical. Accordingly, the cover 18 has a cylindrical opening 19 into which the housing 2 is inserted. Seals 20, approximately in the form of round-section sealing rings, are provided between the circumferential face of the housing 2 and the inner wall of the cylindrical bore 19 of the cover 18. There are also provided seals 21 that are positioned around the high-pressure channel openings 11 and seal off a passage between the high-pressure connection 12 in the cover 18 and the high-pressure channel openings 11 in the end wall 4 of the housing. Such sealing is not necessary in the case of the channel openings 17 for low pressure.

The cover 18 is tightened against the housing 2 by means of a counter-plate 22, which rests against a projection 23 on the housing 2, and by means of bolts 24.

The shaft 10 projects through the first displacement element 8 and is secured, on the projecting side, against axial movement to the rear by means of a securing ring 25. Movement of the shaft 10 in the oppposite direction (axially) is not possible either because the cover 18 there forms an axial bearing.

The shaft 10 is sealed off from the housing 2 by means of a shaft seal 26, which is held in the housing 2 by means of a clamping ring 27. That side of the shaft seal 26 which faces the displacement elements 8, 9 is connected to the pocket 3 by way of a channel 28, so that that side of the shaft seal 26 can be acted upon by the force due to suction.

The assembly of such a machine is extremely simple: first the two displacement elements 8, 9 are placed inside one another and the displacement elements 8, 9, which have been put together, are pushed sideways into the pocket 3. The second displacement element 9 then comes to rest against the base 6 of the pocket 3. At the same time, the shaft 10 is inserted axially into the housing 2 and pushed through the first displacement element 8. The displacement elements 8, 9 are thus secured against falling out or being pushed out during operation. The securing ring 25 can then be placed on the shaft 10. Finally, the cover 18 must also be mounted and the shaft seal 26 must be inserted, and then the machine is finished. All of those steps can be carried out very simply by automatic operating machines (robots).

It should be noted that no changes in the volumes of the machine are made as a result of assembly. Neither are any stresses built up in the region of the displacement elements, for example by the tightening up of bolts. The bolts 24 merely need to be tightened enough for the cover 18 to stay on the housing 2. It is not their role to clamp the displacement elements 8, 9 securely in the pocket 3.

In that manner, a machine having small tolerances can be produced by simple means.

Many materials can be used for the housing and for the displacement elements 8, 9, it being advantageous for the materials in question to have similar thermal expansion coefficients. In particular, materials such as plastics, sintered materials, ceramics or metals, such as aluminium or cast iron, have proved their worth for the housing. Additives may be added to those materials to increase the mechanical strength or the resistance to wear or to improve the friction properties and thus to reduce wear.

If the housing is cast or sintered, provision can be made for the pocket 3 also during manufacture of the housing 2. In that case, in many instances it is only necessary to polish the end walls 4, 5 and the base 6.

In a manner not shown, the machine may be used as a component of another machine element. In that case, that machine element forms the cover 18. This will be explained using the example of a hydraulic cylinder, in which the machine is in the form of a pump and is provided with an electric motor on the shaft 10. A hydraulic cylinder is a hydraulic sub-assembly that consists of the cylinder part proper and a piston part. The pump can be arranged at the end of the cylinder part and can be provided with the electrical connections to drive the motor. The pump merely needs to be connected to a fluid supply. When the motor is actuated, the pump can produce the required pressure inside the hydraulic cylinder without it being necessary to supply pressure from outside. Instead, only one fluid supply is necessary, which can be effected, however, without pressure. Thus, hydraulic operations can thus take place self-sufficiently even when no higher-level hydraulic supply arrangement has been provided.

On or in the cover there may also be provided means for controlling pressure or temperature or for regulating a fluid flow.

Figure 6:
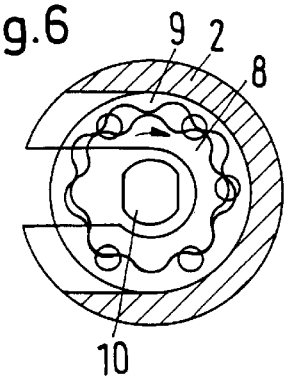
FIGS. 6 to 8 show various examples of displacement elements.
Figure 7:
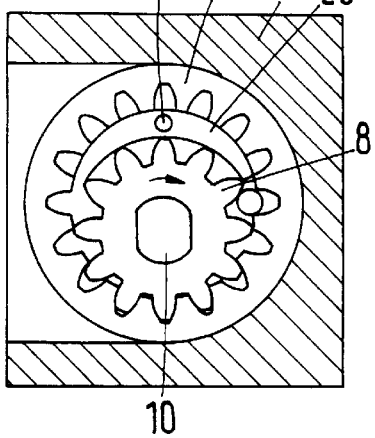
Figure 8:
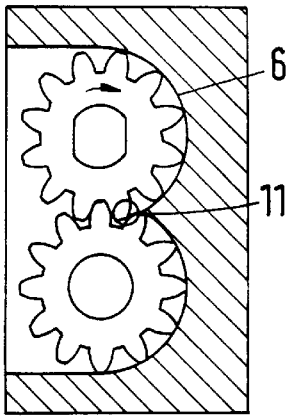

A large number of possibilities exist for combining the two displacement elements, three different embodiments being shown in FIGS. 6 to 8.

FIGS. 6 and 7 each show gerotor arrangements, that is to say arrangements in which the first displacement element 8 is in the form of a toothed wheel and the second displacement element 9 is in the form of a toothed ring. When the first displacement element 8 rotates, it entrains the second displacement element 9 with it. Depending upon the combination of numbers of teeth in the first and second displacement elements 8, 9, the second displacement element 9 in the example according to FIG. 6, for example, turns once when the first displacement element 8 has turned as often as it has teeth.

In the embodiment according to FIG. 7, there is arranged between the first displacement element 8 and the second displacement element 9 a sickle-shaped insertion piece 29 which is held fixed relative to the housing by means of a pin 30. The operation of those two gerotor arrangements is known per se.

FIG. 8 shows a different construction in which the centre points of the two displacement elements are likewise arranged offset in relation to one another. They are, however, no longer nested inside one another but are in the form of toothed wheels, arranged adjacent to one another, that engage one another. In that case, the base 6 of the pocket 3 is formed by two arcuate lines that are adjacent to one another (as seen in cross-section), the circles that form the arcuate lines overlapping one another sufficiently for the two toothed wheels to be able to engage one another. A high-pressure channel opening 11 is required only in the region where the two toothed wheels engage one another. Very high pressures can be obtained using such a toothed wheel pump.

What is claimed is:

1. Fluid machine having a first displacement element, said first displacement element being rotatable about an axis of rotation, a shaft, the first displacement element being connected to the shaft so as to rotate therewith, a unitary housing, the shaft being mounted rotatably in the housing, a second displacement element, the first displacement element being mounted to co-operate with the second displacement element, the axis of rotation being located a predetermined distance from a centre axis of the second displacement element, the housing having a pocket, the displacement elements being located in the pocket so that the housing covers the displacement elements axially on both sides at least in a working region and circumferentially over a maximum of 180°, and in which, during assembly, the shaft is movable only axially relative to the housing and the displacement elements are movable only radially relative to the housing.

2. Machine according to claim 1, in which the shaft is secured axially to the first displacement element.

3. Machine according to claim 1, in which the pocket has an axial extent that is substantially as great as that of the displacement elements.

4. Machine according to claim 1, in which the displacement elements and the housing have similar thermal expansion coefficients.

5. Machine according to claim 1, in which the shaft is sealed in the housing by a shaft seal which is connected to the displacement elements by way of a channel that runs substantially parallel to the axis of rotation.

6. Machine according to claim 1, in which both displacement elements comprise toothed wheels.

7. Machine according to claim 1, in which an axial end wall of the pocket includes a slit.

8. Machine according to claim 7, in which the slit is arranged offset to one side of the shaft.

9. Machine according to claim 7, in which the shaft projects through the first displacement element and into an opening at the one end of the slit.

10. Machine according to claim 7, in which the slit forms part of a low-pressure channel arrangement.

11. Machine according to claim 1, in which the housing includes a high-pressure channel arrangement which is connected to a working region of the pocket.

12. Machine according to claim 11, in which there are formed between the two displacement elements in the working region a predetermined number of work chambers, and the housing has a corresponding number of high-pressure channel openings which are connected to one another and are so arranged that each work chamber is always connected to at least one high-pressure channel opening.

13. Machine according to claim 1, in which the displacement elements co-operate in the manner of a gerotor.

14. Machine according to claim 13, in which the first displacement element comprises a toothed wheel having outside teeth and the second displacement element comprises a toothed ring having inside teeth, the number of teeth of said wheel differing from the number of teeth of said ring.

15. Machine according to claim 13, including a sickle-shaped insertion piece that is fixed relative to the housing and located in a predetermined angular region between the toothed wheel and the toothed ring.

16. Machine according to claim 1, in which the housing is made of a material selected from the group of plastics, sintered material, aluminium, ceramics and cast iron.

17. Machine according to claim 16, in which the housing material includes additives for at least one of increasing the mechanical strength and increasing resistance to wear and reducing friction.

18. A method of forming a fluid machine having a first displacement element that cooperates with a second displacement element, comprising the steps of a. forming a unitary housing, b. milling a pocket in the housing sufficient to accommodate the displacement elements, the pocket being formed so that the housing covers the displacement elements axially on both sides at least in a working region and circumferentially over a maximum 180°, c. installing the displacement elements radially into the housing in the pocket, with an axis of rotation of the first displacement element being located a predetermined distance from a centre axis of the second displacement element, and d. installing a shaft axially relative to the housing and into the first displacement element so that the shaft is rotatable with the first displacement element.

* * * * *